United States Patent [19]

Drummond

[11] 3,972,703

[45] Aug. 3, 1976

[54] GLASS FIBER ATTENUATOR

[75] Inventor: Warren W. Drummond, Allison Park, Pa.

[73] Assignee: PPG Industries, Inc., Pittsburgh, Pa.

[22] Filed: Mar. 31, 1975

[21] Appl. No.: 565,984

[52] U.S. Cl. ..... 65/11 W; 28/75 R; 65/25 R; 198/184; 226/97; 226/172

[51] Int. Cl.[2] ..... C03B 37/02

[58] Field of Search ..... 65/11 R, 11 W, 25 R; 226/97, 172; 198/184; 28/75 R, 71.3

[56] References Cited

UNITED STATES PATENTS

| | | | |
|---|---|---|---|
| 3,106,355 | 10/1963 | Warren | 226/97 X |
| 3,156,399 | 11/1964 | Wadey | 226/97 |
| 3,293,013 | 12/1966 | Drummond | 65/11 W X |
| 3,489,543 | 1/1970 | Kita et al. | 65/25 R |

FOREIGN PATENTS OR APPLICATIONS

| | | | |
|---|---|---|---|
| 4,330,374 | 4/1966 | Japan | 226/97 |

*Primary Examiner*—Robert L. Lindsay, Jr.
*Attorney, Agent, or Firm*—John E. Curley; Robert DeMajistre

[57] ABSTRACT

A glass fiber attenuator is disclosed which is used in the fiber forming process. The attenuator is comprised of two rapidly moving endless belts which travel along a predetermined path. The belts have surface portions which engage glass fiber strand and apply attenuating forces to the fibers which are being drawn. The attenuator has a smooth surface bearing means to abruptly change the direction of movement of the belt with respect to the strand traveling along the predetermined path. At least a portion of one of the belts rides over a stationary member having sufficient porosity to pass a fluid therethrough. Adequate pressure of the fluid causes the belt to ride on the fluid along the predetermined path.

6 Claims, 5 Drawing Figures

FIG.4
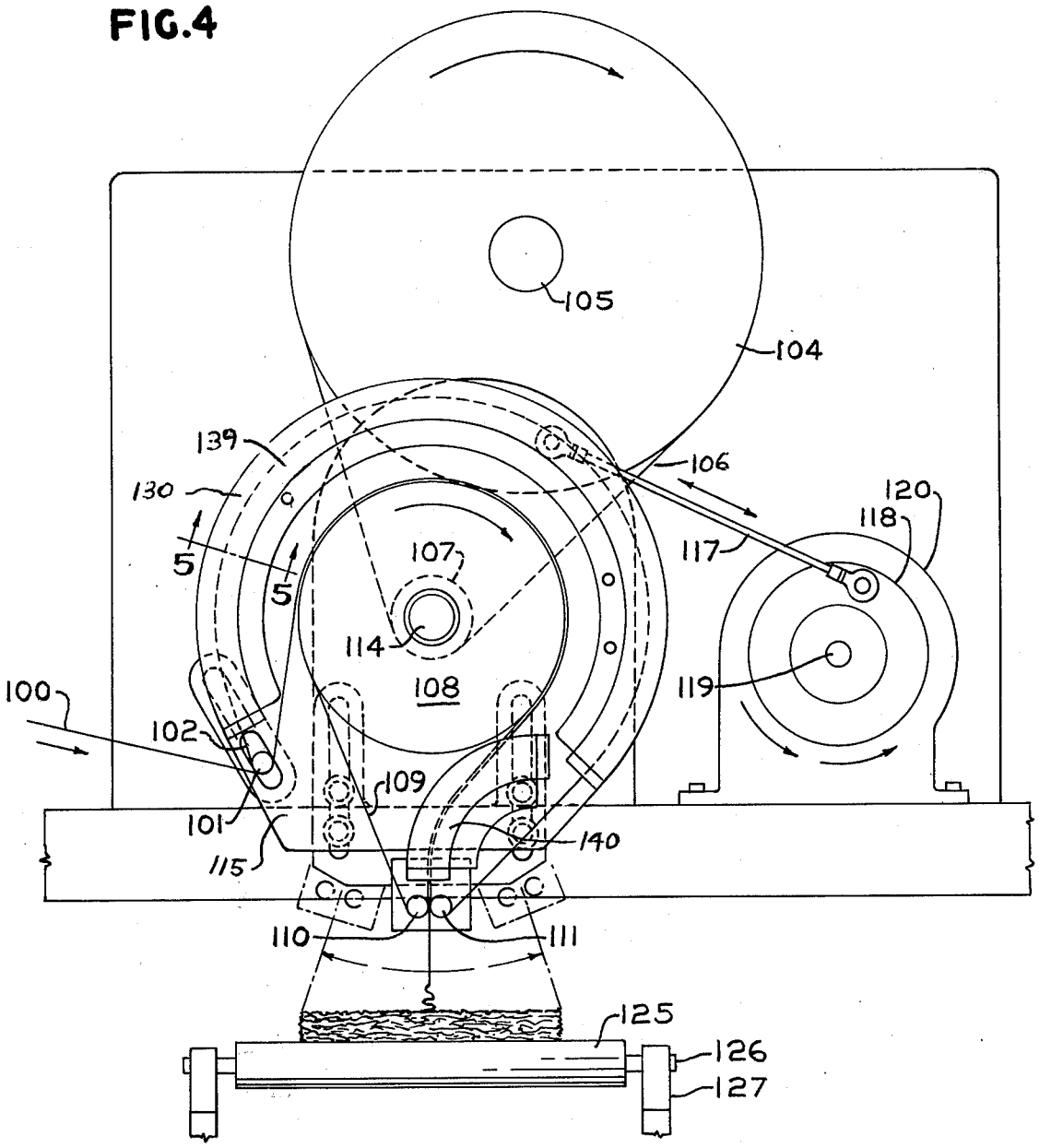
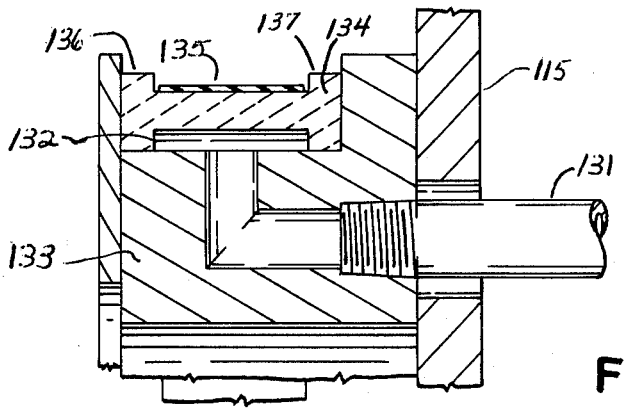
FIG.5

GLASS FIBER ATTENUATOR

BACKGROUND OF THE INVENTION

This invention relates to the production of glass fibers and glass fiber products. More particularly the invention relates to high speed glass fiber attenuators.

Glass fibers are formed by attenuating molten cones of glass at tips of orifices in a fiber forming bushing. The attenuating forces are supplied by the engagement of the filaments with the exterior of a sleeve received by a rotary spindle and the strand is wound on the sleeve as a forming package.

Another means of applying attenuating forces to the fibers is by pulling the strand between two continuous surfaces traveling at high speeds such as is shown in U.S. Pat. No. 3,293,013 incorporated herein by reference. These high speed attenuators have found utility in the production of glass fiber products having a broad range of uses. One such product, crimped glass fibers, is disclosed in U.S. patent application Ser. No. 425,974, filed Dec. 18, 1973 by Warren W. Drummond, incorporated herein by reference.

In order to form such products, a plurality of strands in parallel form are passed through the opposing flexible surfaces or belts at speeds on the order of 25 to 100 meters per second. These high speeds produce great mechanical strains on the rotating parts of the attenuator and substantially contribute to mechanical bearing failures.

Therefore, there has been a need in the utilization of such attenuators to reduce the friction caused by the high speed travel of the flexible surfaces, i.e., belts across stationary guides while the belts travel along their predetermined path.

THE PRESENT INVENTION

In accordance with the instant invention, a glass fiber attenuator is provided with substantially reduced friction over the stationary portions which the belts of the attenuator pass while traveling along their predetermined path.

An attenuator is provided with a pair of endless belts having surface portions which engage one another and between which glass fiber strand is fed and attenuated at high speed. Stationary bearings are provided to abruptly change the direction of movement of the belts with respect to the predetermined path thereof, thus permitting the strand to continue to move along its predetermined path and be projected into space after disengagement from the attenuating belts. A stationary member is provided over which at least one of the belts rides while that portion of the belt proximate to the stationary member is disengaged from the strand. This stationary member guides the belt along its predetermined path and is not associated with the abrupt change in direction of the belts. The stationary member is constructed of a material such as graphite to provide adequate porosity to pass a fluid therethrough, thus providing a layer of the fluid between the belt and the stationary member while the belt is moving along the predetermined path.

Other aspects of the invention will become apparent by reference to the accompanying drawings in which:

FIG. 4 shows an attenuator made in accordance with the practice of the invention laying down a continuous mat; and FIG. 5 is a cross-sectional view of the stationary guide surface on which the belts of the attenuator ride taken cross the 5—5 line of FIGS. 1, 2 and 4.

Figure 1:
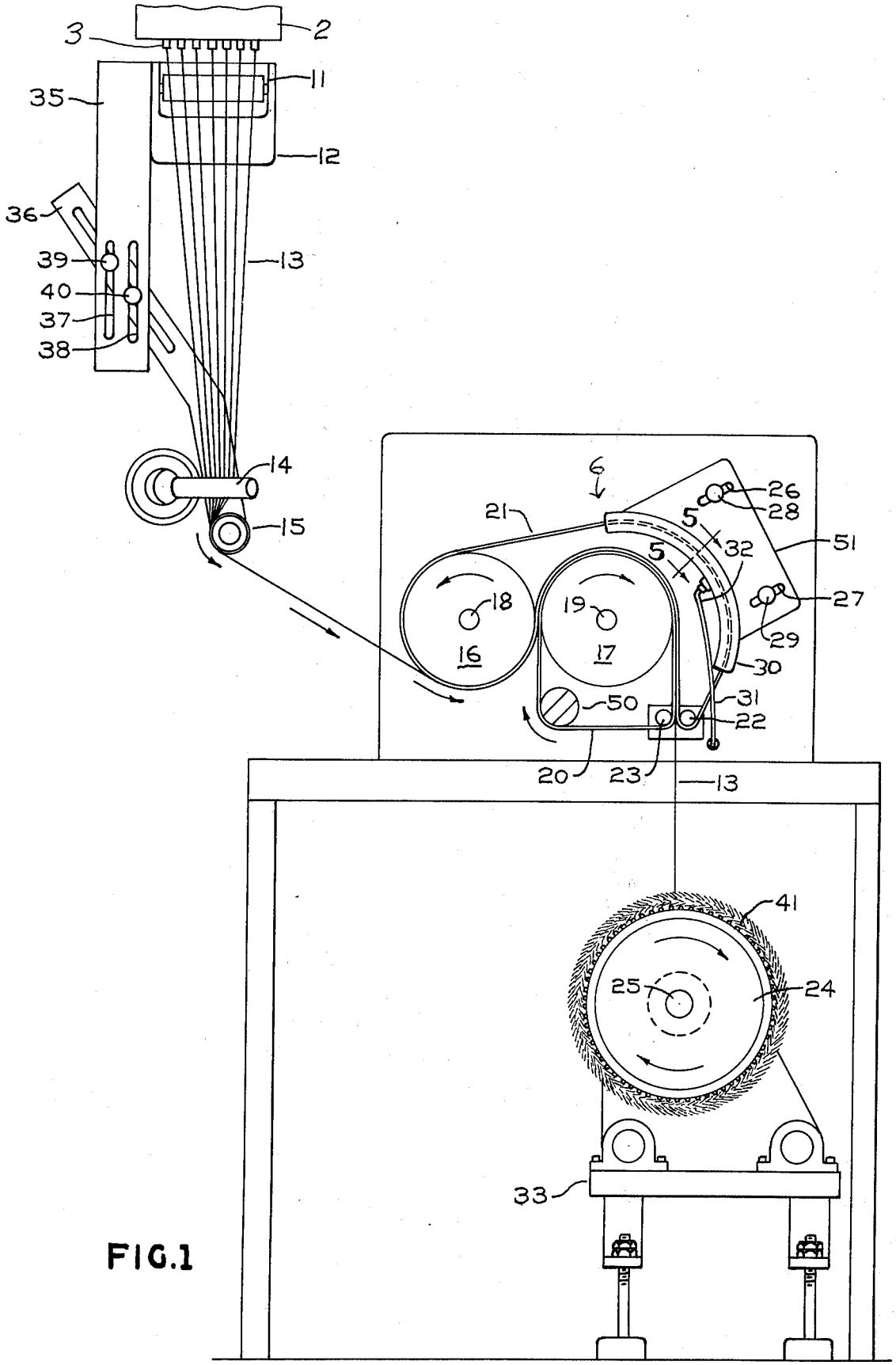
FIG. 1 is a view in perspective of an attenuator of the invention being used to produce mats on a rotating mandrel.
Figures 2, 3:
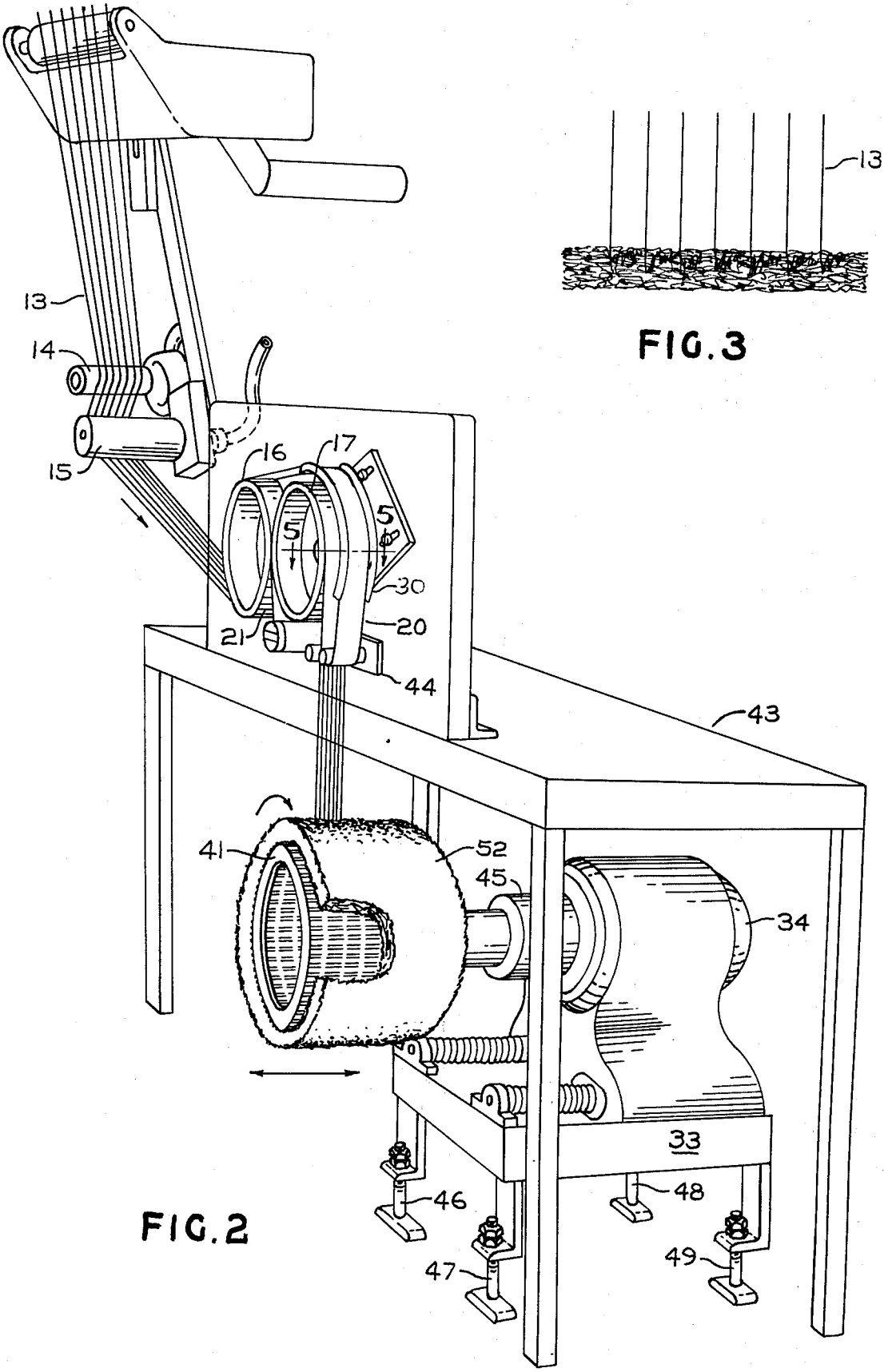
FIG. 2 is a side elevation of the apparatus of FIG. 1.
FIG. 3 is a diagrammatic illustration of a portion of the fiber glass mat during formation with the strands being released by the attenuator of the invention.

Turning to the drawings, and FIGS. 1 and 2 in particular, there is shown a bushing 2 having bushing tips 3 through which a plurality of glass filaments 13 are drawn. The filaments 13 are drawn across a roller applicator 11 housed in a reservoir 12 with suitable sizing being applied to the fibers as they are being drawn across the applicator. The applicator is held in place by a bracket 35 having a side arm 36 associated therewith which is adjustable in a vertical direction utilizing the slots 37 and 38 and the bolts 39 and 40. Located on the lower end of the side arm bracket 36 is a guide shoe 15. Positioned directly above the guide shoe 15 and positioned at an angle to the long axis thereof is a strand separator 14.

The attenuator 6, as is shown in the drawing, has two pulleys 16 and 17 which are rotated by drive shafts 18 and 19 associated with a suitable motor not shown. Pulley 16 has a belt 21 associated therewith. Pulley 19 has a belt 20 associated therewith. Tension on the belts can be adjusted by movement of the plate member 51 utilizing slots 26 and 27 therein and the set screws or bolts 28 and 29. Associated with the belt 21 is an air shoe 30, having a suitable air supply line 31 and an air distributing cap 32. The air shoe 30 is constructed of graphite which has sufficient porosity to pass air therethrough and support the belt 21 while the attenuator is drawing the fibers 13. Thus, the belt 21 rides on the air emanating from the graphite air shoe 30. In place of graphite the air shoe 30 may be constructed of a metal plate with a plurality of orifices thereon sufficient to pass adequate air to support the belt 21. Air pressure is applied at a range of 30 to 50 pounds per square inch ($2.0 \times 10^5$ to $3.5 \times 10^5$ pascals) to adequately support the belt 21 over the air shoe 30. In lieu of air, another fluid such as water, nitrogen or the like may be used. Belts 21 and 20 turn around stationary pins 22 and 23, respectively, with belt 20 passing over idler 50. The pins 22 and 23 may be supplied with a plurality of holes therein to pass air so that both belts 20 and 21 ride on air when the belts 22 and 23 abruptly change direction. Located beneath the stationary pins 22 and 23 is a rotatable mandrel or collet 24 driven by a shaft member 25 associated with a suitable motor 34. The motor is mounted on a table 33 and may be leveled utilizing the leveling foot members 46, 47, 48 and 49 associated with the table 33. Ridges 41 are provided on the surface of the rotating collet 24 to assist in the collection of fibers on that surface and to permit the finished fiber glass mass or mat to be removed easily from the surface of the rotating mandrel 24.

In FIG. 3 is a portion of a mat formed on the rotating mandrel 24 of FIG. 2 and cut from the surface of the mat 52 shown therein, depicts the orientation of the crimped glass fibers as they appear in the finished product. It is to be noted that the fibers are interlocked and that the projection of the fibers 13 onto the mat surface as it is being formed is such that the penetration to a considerable depth below the surface of the mat as it is being formed is accomplished due to the high velocity of travel of the fibers as they are collected on the slowly rotating mandrel. The high velocity of the fiber 13 is attributed to the high velocity of the attenuator belts projecting the strand. The graphite air shoe or bearing shown in FIGS. 1, 2, 4 and 5 allows these belts to travel at high speed with minimal friction, hence prolonging the life of the attenuator belts. Thus, the high inertial forces provide crimped fibers which as the mat is formed, provide a mat structure which has the appearance of a needled mat though no needling was used.

In FIG. 4, a further modification of the instant invention shows a glass fiber attenuator which is suitable for utilization in preparing a continuous fiber glass flat mat formed on a belt type conveyor. In FIG. 4 fiber glass strands 100 are passed across the stationary pin 101 and on top of a belt member 102. Also shown in FIG. 4 is a large pulley 104 connected to a suitable drive shaft member 105 of a motor, not shown, and having a belt 106 associated therewith. Belt 106 revolves around pulley 107 mounted on shaft 114 over a second pulley 108 also mounted on shaft 114 to impart rotation thereto. Pulley 108 has also associated with it a second belt member 109 affixed to the surface of pulley 108 and revolving around the pulley and stationary pin 110. Belt 101 travels on the outer surface of the pulley 108 on top of belt 109 and is turned around a second stationary pin member 111. The pulley 107 is rotated on a pivot pin or shaft 114 which rotates pulley 108. Support member 115 is movable in a reciprocating sidewise direction if desired on the outside of the spindle housing through bearing supports not shown in the drawing. Bolted to the frame of the apparatus is a rocker arm 117 which is affixed to a pulley 118 associated with the drive shaft 119 of a secondary motor 120 to impart reciprocal motion to the entire frame assembly by pivoting the assembly and its associated belts 109 and 102 revolving around pulley 108 on the bearing supports for the shaft 114 as stated above. The strand 100 is directed in a straight line from between the belts 109 and 102 as they pass the stationary pins 110 and 111 and are collected on a forming surface 125 which may comprise an endless belt such as a chain conveyor rotated on a shaft member 126 coupled to a suitable cam shaft 127 which is connected to a motor (not shown).

Mounted on the support member 115 is a ridged support 139 which maintains the air shoe or bearing 130 in a stationary position. The air shoe or bearing 130 is constructed preferably of graphite and of sufficient porosity to pass air therethrough in order that the belt 102 rides on the air interposed between the belt 102 and the air shoe 130. Between the air shoe 130 and the ridged support 139 there is an air chamber which will be further described in FIG. 5.

In operation of the embodiments shown in FIGS. 1 and 2, fiber glass strands 13 are drawn from a bushing tips 3 in a bushing 2, across an applicator 11 and a suitable lubricant such as an amino silane is applied thereto. Any conventional glass fiber lubricant may be used, providing the resultant crimped fibers are not lubricated to the extent that the crimp releases due to lack of friction. Typical of lubricants found acceptable for these purposes are water, gamma methacryloxypropyl silane, gamma amino propyl silane, emulsified epoxy resins and the like. The strands 13 as they are drawn downwardly across the applicator are passed across the separator 14 which is positioned slightly across the guide shoe 15 and imparts sufficient force to the fibers as they are being drawn around the guide shoe 15 to maintain the strands in a separated position as they pass under the shoe 15. The fibers are then picked up on the underside of the belt 21 as it revolves around pulley 16 and on the outside surface of belt 20 as it revolves about pulley 17. Belts 21 and 20, with the separated strands sandwiched in between, travel around the pulley 17 and downwardly until they reach the stationary pins 22 and 23.

The belt 21 rides over the graphite air shoe or bearing 30 on the air eminating therefrom provided by the air tube 31. The graphite air shoe or bearing 30 guides the belt 21 along its predetermined path with minimal friction and wear.

After their release from belts 21 and 20, the parallel strands 13 are projected downwardly at high speed until they reach the stationary pins 22 and 23. At this point the parallel strands 13 are projected downwardly at high speed until they strike the surface 41 of the rotating collet 24. Upon striking this surface, which is at right angles to the path of travel of the strands, each of the strands is bent as the strand travels to the surface of the approximate order of two to four sharp bends or more per linear inch of strand. The bends are counted by measuring a length of the product in the stretched condition and relaxing it after measurement of this length to count the flexes in the length measured. The strand 13 as it travels over the stationary pins 22 and 23 travels at rates of speed varying between 25 to 100 meters per second. The collet member 24 is revolving at approximately 2.5 to 7.6 peripheral meters per second and the operation is continued until a mat of any desired depth is produced on the collet member 24. When the strands have reached the desired depth the mat is pulled from the collet and the mandrel is ready for further collection of strands. The motor 34 associated with the collet 24 in addition to imparting rotational movement to the winder or collet 24 reciprocates in a horizontal direction at speeds of travel between 3 and 30 feet per minute thereby permitting the strand to build up across the face of the periphery of the winder 24 while the winder 24 is being rotated at slow speed. This provides for a uniform deposition of strand across the surface 41 of the winder 24 and while it is rotating to provide for uniform deposition around the winder also. Donut shaped packages of crimped fiber glass of any uniform thickness are thereby formed on the winder 24.

In the device shown in FIG. 4 the paralleled strands 100 are passed under the belt moving over stationary air pin 101 onto the top surface of the belt 102. The strands are caught between this belt and belt 109 as they pass upwardly to the periphery of the pulley 108. The strands once again are passed over a suitable guideshoe, not shown, in FIG. 4 to maintain the individual strands in an essentially spaced parallel relationship with respect to each other. The strands are passed around the pulley 108 between the two belts until they reach the stationary guidepins 111 and 110. At this point belt 102 is bent and returned to the stationary pin 101 and belt 109 is flexed and turned back to the surface of pully 108. The strands 100 are projected at high speed in a vertical direction into space. During this operation motor 120 is activated and the armature 119 rotates the disc 118 to impart to the rod 117 a reciprocating motion. The rod 117 pushes the entire attenuating device first to the left and then returns it to the right. This reciprocates the stationary pins 110 and 111 and their relationship to the collecting surface 125 so that the fibers contact the surface all across the stationary belt 125 which is moving at a slow rate of speed due to the rotation of the shaft 126 by its connection 127 to a second motor not shown. The driving force for the pulley 108 is supplied by pulley 104 which is associated with a drive shaft 105 connected to a second motor. As the strands move from the belts 109 and 102 in a vertical direction against collecting surface 125 the strand is collected in a horizontal direction in two planes, that is, the strand is collected along the width of the roll 125 and along its length as it moves in the horizontal plane by rotation of shaft 126.

The belt 102 is guided along its predetermined path over the air shoe 130. Sufficient air is provided to interpose a fluid layer between the belt 102 and the air shoe 130 so that the belt 102 rides on the fluid layer.

Both belts 102 and 109 are supported by the air shoe on bearing 140 constructed of graphite or perforated metal of sufficient porosity to pass air therethrough. The belts 102 and 109 are bounded at their outside surfaces (the surfaces not contacting the strand 100) by the bearing 140 and the belts 102 and 109 are supported by the air emanating from the bearing 104.

FIG. 5 is a cross-section taken along the 5—5 line of FIGS. 1, 2, and 4. In FIG. 5 an air tube 131 conveys air to an air chamber 132, which is defered by the bearing support 133 and the graphite shoe 134. The graphite shoe 134 has sufficient porosity to uniformly pass the air from the air chamber 132 through the graphite shoe 134 and support the belt 135. Thus the belt 135 rides on the air provided by the air source (not shown in FIG. 5). Typically, an air pressure of 30 to 50 pounds/square inch ($2.0 \times 10^5$ to $3.5 \times 10^5$ pascals) is necessary to support the belt 135 as it travels along its predetermined path. Ridges 136 and 137 prevent the belts 135 from slipping off its predetermined path.

In lieu of air, water may be used to support the belt 135. Also the graphite shoe may be constructed of metal with sufficient porosity of allow adequate air to pass therethrough to support the belt 135. The bearing support 123 is mounted on the support member 115 which supports the belt assembly.

Although the invention has been described in relation to specific embodiments thereof the invention is not to be limited except as set forth in the following claims.

I claim:

1. In an apparatus for producing glass fiber strands which includes:

a fiber forming bushing containing molten glass and having a plurality of orifices through which said molten glass flows in streams, said streams being attenuated into fibers;

means for gathering said fibers into strand;

a pair of endless flexible belts having surface portions which engage one another and between which said strand is fed to be engaged by said engaging portion;

means to rapidly move said flexible belts along a predetermined path so as to move said engaged strands along the same path and to apply attenuation forces to said fibers; and means to release said strand from said flexible belts to disengage said strand from said flexible belts and project said strand into space, the improvement which comprises a belt tensioning means comprising a plate member movable with respect to the path of movement of one of the belts, a porous, arcuate guide member having a channel-shaped recess adapted to recieve and guide said belt and means for supplying a gaseous fluid to said porous, arcuate guide means whereby said gaseous fluid permeates said guide means and exits along the belt supporting surface of said channel.

2. The apparatus of claim 1 wherein said stationary member is graphite.

3. The apparatus of claim 1 including a second porous arcuate guide member over which both of said belts ride.

4. The apparatus of claim 1 wherein said means to release said strand is a smooth surfaced bearing means which abruptly changes the direction of movement of said flexible belts.

5. The apparatus of claim 1 including a support member for supporting said guide member, said guide member and said support member defining a chamber into which air is fed, said chamber distributing the air through said guide member.

6. The apparatus of claim 3 wherein said second stationary member is graphite.

* * * * *

UNITED STATES PATENT OFFICE
CERTIFICATE OF CORRECTION

PATENT NO. : 3,972,703

DATED : August 3, 1976

INVENTOR(S) : Warren W. Drummond

It is certified that error appears in the above-identified patent and that said Letters Patent are hereby corrected as shown below:

Column 4, line 62, "pully" should be --pulley--.

Column 5, line 25, "104" should be --140--.

Column 5, line 41, "of" should be --to--.

Column 6, Claim 1, line 26, "recieve" should be --receive--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*